United States Patent [19]

Patrick, Jr.

[11] 4,353,219

[45] Oct. 12, 1982

[54] SELF-CONTAINED AMBIENT PRECOOLER ATTACHMENT FOR AIR-COOLED CONDENSING UNITS

[76] Inventor: Robert L. Patrick, Jr., 508 Concord Ave., Belton, Mo. 64012

[21] Appl. No.: 140,167

[22] Filed: May 19, 1980

[51] Int. Cl.[3] ..... F25B 39/04; F28D 5/00

[52] U.S. Cl. ..... 62/183; 62/305; 62/315

[58] Field of Search ..... 62/304, 305, 181, 183, 62/237, 171, 315, 262

[56] References Cited

U.S. PATENT DOCUMENTS

| | | | |
|---|---|---|---|
| 2,655,795 | 10/1953 | Dyer | 62/305 |
| 3,215,059 | 11/1965 | Haas | 62/237 |
| 3,913,345 | 10/1975 | Goettl | 62/305 |
| 3,984,995 | 10/1976 | Starr et al. | 62/305 |
| 4,182,131 | 1/1980 | Marshall et al. | 62/305 |
| 4,212,172 | 6/1980 | Manno | 62/305 |
| 4,274,266 | 6/1981 | Shires | 62/305 |

*Primary Examiner*—Albert J. Makay
*Assistant Examiner*—Harry Tanner
*Attorney, Agent, or Firm*—Schmidt, Johnson, Hovey & Williams

[57] ABSTRACT

The jacket-like precooler embraces the condensing unit of a residential air conditioning system to position porous fill media of the jacket in upstream airflow relationship to air inlets of the unit. A water discharge manifold along the upper extent of the media may be connected to an outdoor spigot, and a pump situated in a reservoir at the base of the jacket, when plugged into an outdoor electrical outlet, is operable to recirculate water to the manifold after gravitating through the media and precooling ambient air drawn transversely into the unit. A float valve prevents makeup water supplied by the spigot from entering the system when the reservoir is filled to a certain depth, and actuation of the pump is withheld until the ambient air exceeds a certain predetermined temperature. Moreover, the pump is only actuated when the condensing unit itself is in operation as determined by a pressure sensitive device situated within the stream of air drawn into the unit. An alternative embodiment adds the capability of temporarily deactivating the pump and continuously feeding only makeup water to the manifold if the temperature of collected water within the reservoir exceeds a certain predetermined level.

6 Claims, 6 Drawing Figures

SELF-CONTAINED AMBIENT PRECOOLER ATTACHMENT FOR AIR-COOLED CONDENSING UNITS

TECHNICAL FIELD

This invention relates to air-cooled condensing units normally associated with residential air conditioning systems and, more particularly, to an attachment which may be added by the homeowner to an existing condenser unit for the purpose of precooling ambient air drawn into the unit when the temperature of the ambient air exceeds a certain level.

BACKGROUND ART

It is, of course, well known that ambient air may be cooled by passing the same in cross-flow relationship to media saturated with cooler water. On the other hand, to my knowledge, no one has heretofore utilized this basic principle in connection with an attachment for precooling ambient air drawn into air-cooled condensing units of residential air conditioning systems.

SUMMARY OF THE PRESENT INVENTION

Accordingly, one important object of the present invention is to provide an attachment for existing residential, air-cooled condensing units which can be readily installed and maintained by the homeowner for precooling the ambient air drawn into such units under certain ambient temperature conditions. It is intended that the attachment will be essentially self-contained, requiring only that it be plugged into an adjacent electrical outlet to supply electrical power for a recirculating pump and coupled via a garden hose or the like to a water spigot for supplying makeup water to the attachment at appropriate times.

The attachment is in the form of a jacket which at least partially envelopes the unit and contains upright fill media through which cooling water gravitates in transverse flow relationship to ambient air drawn into the jacket by operation of the unit. The fill is in upstream airflow relationship to the air inlets of the unit so that ambient air must pass through and be cooled by the media prior to entering the unit and passing across the hot condensing coils thereof. A pump situated in a collecting reservoir beneath the fill media recirculates the water to an overhead manifold above the media but is only actuated when the condenser unit is itself in operation and only when the temperature of the ambient air exceeds a certain predetermined level. A float valve associated with an inlet port coupled with the spigot-supplied water prevents the addition of new makeup water into the reservoir unless the water level within the reservoir drops to a predetermined level. An alternative arrangement provides for deactivating the pump to avoid recirculation and for diverting fresh makeup water directly to the manifold in the event that the water temperature of the reservoir exceeds a certain predetermined level.

DETAILED DESCRIPTION

Figure 1:
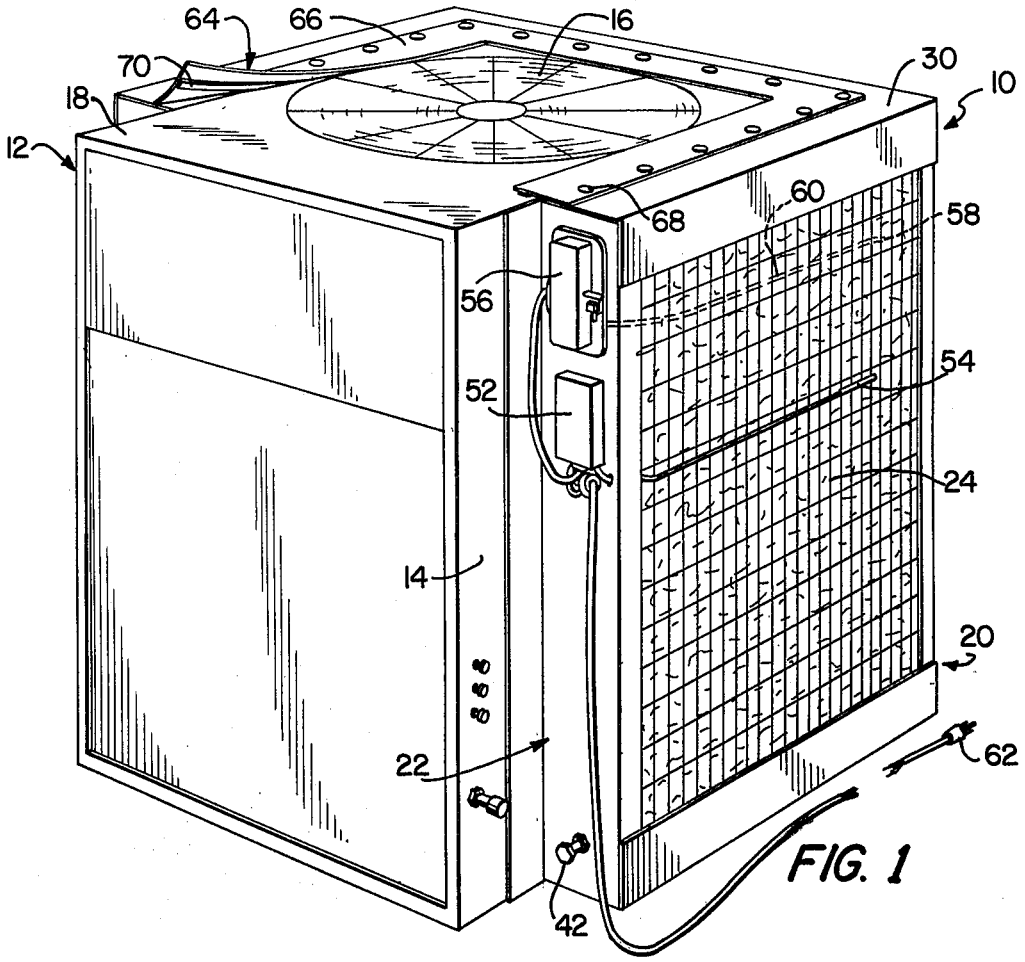
FIG. 1 is a right front perspective view of a precooler attachment constructed in accordance with the principles of the present invention and shown in connection with a selected air-cooled condenser unit.

The attachment 10 may assume a number of different general configurations depending upon the particular shape of the condensing unit with which the attachment is to be utilized. In the illustrated embodiment, the attachment 10 is generally U-shaped in plan for use in connection with a rectangular or cube-shaped condenser unit 12 having ambient air inlets located in the sides 14 thereof and a fan-powered exhaust 16 located in the top 18 thereof. Typically, the unit 12 will rest upon a concrete pad or the like (not shown) adjacent the exterior of the house, and it is contemplated that the attachment 10 will likewise rest upon such pad.

The attachment 10 is in the nature of a jacket 20 which envelopes the unit 12 on three of its four sides 14 in upstream airflow relationship to the air inlets (not shown) located in each of the three sides 14 of the unit 12. The jacket 20 is three-sided so as to be complementally shaped with respect to the unit 12 and to receive the latter within the open area defined by the U-shaped nature of the attachment 10. An open, upstanding frame 22 of the jacket 20 supports porous fill media 24 that preferably takes the form of split and expanded craft, treated with copper quinolinolate available from Research Products Corp. of Madison, Wis. A manifold 26 extends along the top portion of the fill media 24 and is provided with a series of outlet nozzles 28 for discharging water to the media 24 during operation. The manifold 26 is housed beneath a transversely inverted U-shaped lid or cover 30 of the frame 22, such cover 30 being removably held in place by a series of screws 32 or the like connecting the cover 30 with adjacent portions of the frame 22 so that the media 24 may be selectively exposed for periodic maintenance or replacement if necessary or desirable.

A reservoir 34 is defined at the bottom of the jacket 20 by upwardly opening, U-shaped channels of the frame 22 for receiving and collecting water that has gravitated through the media 24. A pump 36 is adapted when actuated to draw water out of the reservoir 32 and into a conduit 38 communicating with a line 40 that in turn leads to the manifold 26. A fitting 42 situated externally of the jacket 20 projects from a valve housing 44 and communicates directly with a supply tube 46 projecting into the reservoir 34 from the housing 44. Thus, the fitting 42 adapts the jacket 20 to be connected via a garden hose or the like to a source of water supply under pressure, e.g., to an outdoor spigot. A port 48 at the innermost end of the supply tube 46 is controlled by a float valve 50 so as to be normally closed and thereby prevent the introduction of makeup water via fitting 42. When the level of water within the reservoir 32 falls to a certain predetermined level, the float valve 50 will open the port 48 to allow the introduction of fresh makeup water.

A first electrical switch 52 mounted on the outside of the frame 33 is a single-pole, single-throw switch that is normally open. Switch 52 is responsive to ambient air temperature sensed by a probe 54 placed at an acceptable location. A second switch 56 is likewise mounted on the outside of the frame 22 and is likewise a normally open, single-pole, single-throw switch. The switch 56 is responsive to the existence of a pressure differential between the end 58 of a tube 60 and an opposite end (not shown) of the tube 60 housed internally of the switch 56. Upon sensing such pressure differential, the switch 56 closes, and it is contemplated that the end 58 of the tube 60 will be so located that it will provide closing of the switch 56 in response to a substantial movement of air, either intake or exhaust, associated with operation of the unit 12. Thus, the switch 56 will close when the unit 12 is in operation.

Figure 5:
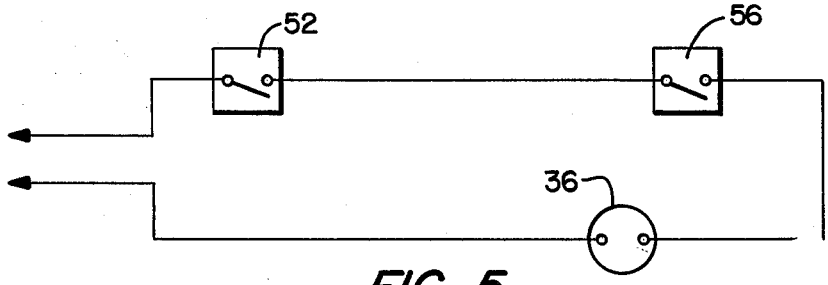
FIG. 5 is a schematic diagram of the wiring circuit for the attachment.

The switches 52 and 56 are connected in an electrical series relationship as illustrated in FIG. 5. The pump 36 is series-connected with the switches 52 and 56 in the same circuit such that, when a plug 62 is inserted into an outdoor receptacle on the house, electrical current may be supplied to the pump 36 if both of the switches 52 and 56 are closed, i.e., when the ambient air temperature exceeds a certain predetermined level and the unit 12 is in operation as determined by the pressure differential tube 60.

The jacket 20 is also provided with a seal broadly designated by the numeral 64 used to close off gaps between the jacket 20 and the unit 12 so that, when the unit 12 is in operation, ambient air will be drawn in exclusively through the media 24 instead of also around the edges of the jacket 20. The seal 64 includes a flap 66 of imperforate material extending along the entire margin of the jacket 20 at its interface with the unit 12. At one marginal extreme of the flap 66, a series of snaps 68 or the like may be provided for attaching the flap 66 to the frame 22. At the other extreme the flap 66 may be provided with structure in the form of ferro-magnetic strips 70 attached adhesively to the underside of the flap 66 and adapted to adhere to the proximal metal surface of the top 18 of unit 12. Of course, the seal 64 may take several different forms and the version illustrated here is for pusposes of example only.

Figure 2:
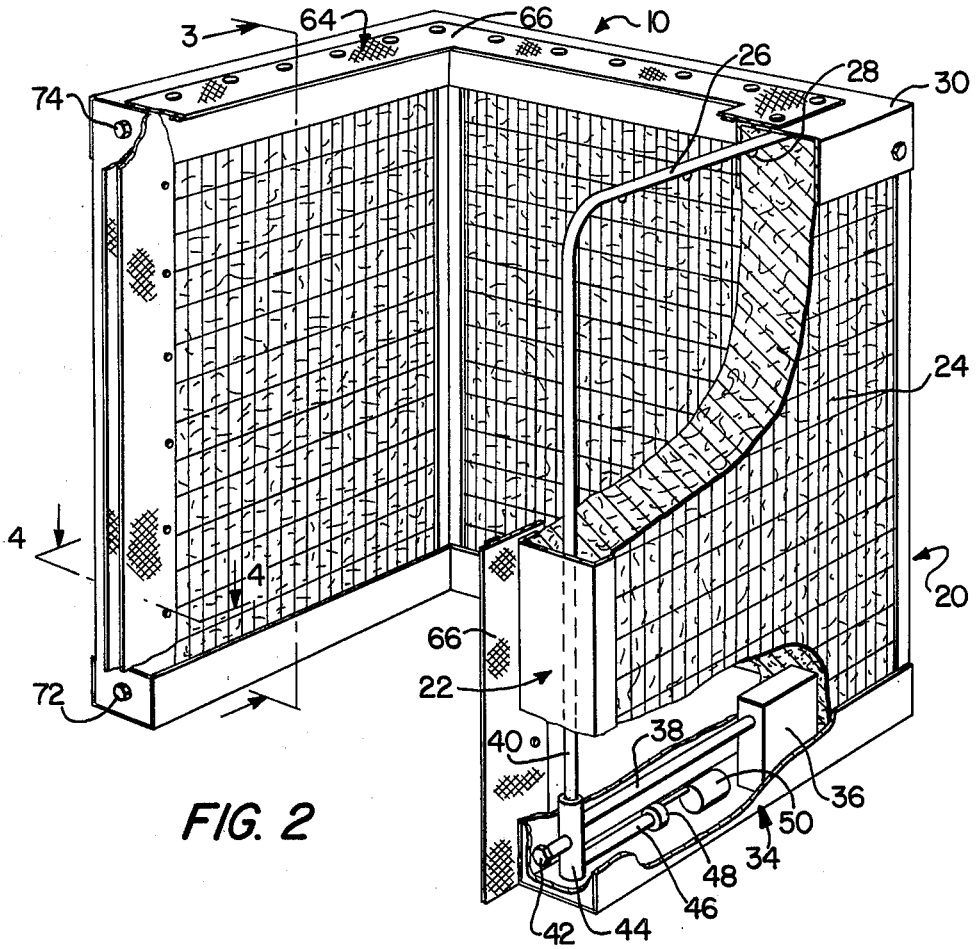
FIG. 2 is an isolated perspective view of the attachment itself, parts being broken away to reveal details of construction.
Figure 3:
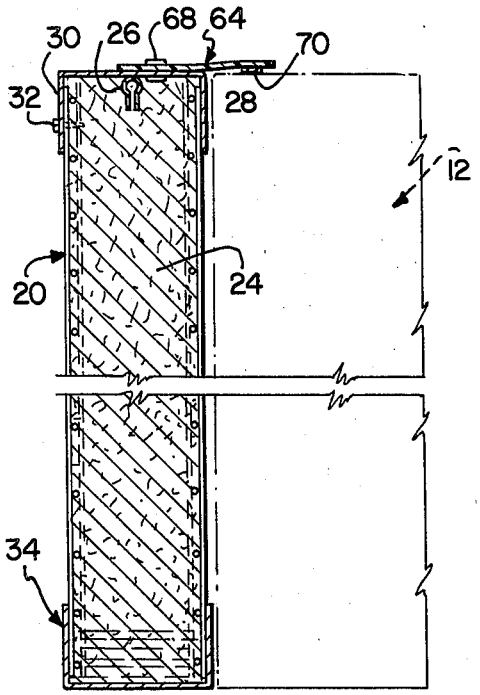
FIG. 3 is an enlarged, fragmentary cross-sectional view of one section of the attachment taken substantially along line 3—3 of FIG. 2.
Figure 4:
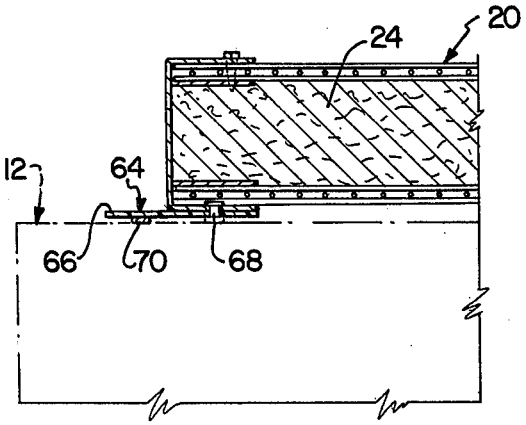
FIG. 4 is an enlarged, fragmentary cross-sectional view through the section taken substantially along line 4—4 of FIG. 2.

As illustrated in FIG. 2, that end of the reservoir 32 remote from the pump 36 is provided with a fitting 72. Likewise, the corresponding end of the manifold 26 is provided with a fitting 74. Such fittings 72 and 74 are adapted to communicate their respective reservoir 34 and manifold 26 with corresponding portions of an additional section of the jacket 20 (not shown) which may be used in certain circumstances if it is necessary to completely envelope all four sides of the particular condensing unit involved. Thus, the fittings 72 and 74 render the attachment 10 somewhat modular in nature.

Figure 6:
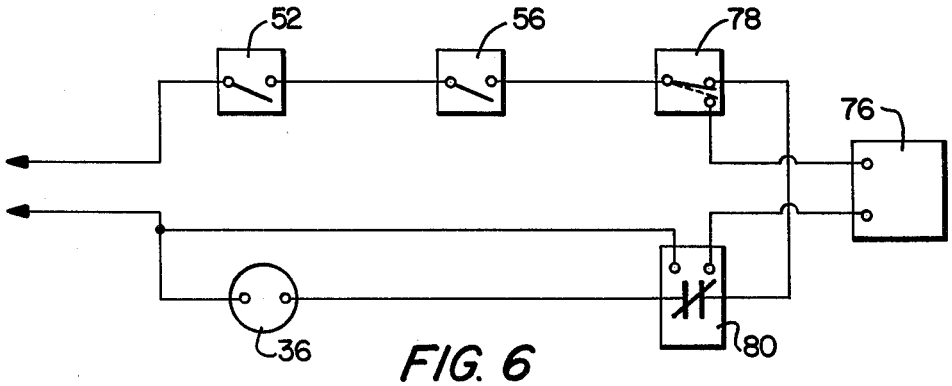
FIG. 6 is a schematic diagram of an alternative wiring circuit for the attachment.

As an alternative embodiment, the attachment may be modified slightly in order to provide the additional capability of introducing only fresh, cool water to the manifold 26 in the event that the temperature of the recirculating water within reservoir 34 exceeds a certain predetermined level. It is contemplated that such embodiment would provide a two-position solenoid 76 (FIG. 6) within the valve housing 44 of FIG. 2. The solenoid 76 will be operable in its actuated position to block communication between the fitting 42 and the supply tube 46 while allowing communication between the fitting 42 and the line 40. In its unactuated position, the solenoid 76 will block communication between the fitting 42 and the line 40 while allowing communication between the fitting 42 and the supply tube 46. The electrical circuit for such an arrangement is illustrated in FIG. 6, wherein it may be seen that the switches 52 and 56 are connected in series with a water-temperature-sensitive switch 78 of the single-pole, double-throw type. The switch 78 is normally closed as illustrated in FIG. 6 so that, when the switches 52 and 56 are likewise closed, a circuit is completed via the relay 80 that energizes the pump 36. On the other hand, when the temperature of the water within the reservoir 34 reaches the predetermined level, the switch 78 switches to its alternate position shown in phantom lines, closing the circuit to the solenoid 76 and actuating the same in the above-mentioned manner. This also operates the relay 80 to bypass the pump 36.

OPERATION

Installation of the attachment 10 is a simple process. It is only necessary to slip the jacket 20 around the unit 12, properly position the sealing flap 66, insert the plug 62, attach a garden hose to the fitting 42, and turn on the outdoor spigot to which the hose is attached. Assuming that the circuit of FIG. 5 is utilized, the pump 36 will remain deactuated until such time as the unit 12 is in operation and the probe 54 senses that the ambient temperature has reached or exceeded a preselected temperature such as, for example, 90° F. Of course, the float valve 50, prior to that time, will have opened the port 48 for a sufficient length of time to allow the reservoir 34 to be filled to a predetermined level all along the bottom of the media 24 from the spigot. Once the pump 36 is actuated, it draws water out of the reservoir 34 and supplies it to the manifold 26 via conduit 38 and line 40 so that the water will then gravitate through the media 24 as ambient air is drawn in transverse relationship thereto through the media 24 into the inlets of the unit 12. Thus, the ambient air is precooled by the gravitating water and provides a greater ability to absorb heat from the hot condenser coils of the unit 12 before exhaustion via the exhaust 16. This substantially improves the operating efficiency of the condenser unit 12.

Unless the level of water within the reservoir 34 falls below its certain predetermined depth, the pump 36 will simply operate to recirculate the same body of water initially supplied via the fitting 42. When the level falls below the predetermined depth, the float valve 50 will open port 48 as frequently as may be necessary to supply makeup water to the reservoir 34.

In the embodiment of FIG. 6, the operation is quite similar in most respects to that explained with regard to FIG. 5. However, in the FIG. 6 arrangement, should the temperature of the water in reservoir 34 exceed a certain level, the solenoid 76 will immediately divert makeup water directly to the manifold 26 via line 40 instead of feeding it to the reservoir 34 via the supply tube 46. Water gravitating through the media 24, instead of being recirculated by the pump 36 (which is deactuated at this time), simply overflows the reservoir 34 or is discharged via a suitable outlet (not shown). When the temperature of the water within the reservoir 34 falls back down below the predetermined level for actuation of the solenoid 76, the normal operating mode will be reestablished wherein the pump 36 is again energized to recirculate the water.

It should thus be apparent that the attachment 10 as above described provides a significant advantage to the homeowner in raising the operating efficiency of his air conditioning system and thereby lowering his utility costs. It should also be noted that even during those times that the attachment 10 is not in operation, such as when the ambient temperature is below 90° F., the media 24 serves as an additional filter for the air entering the condensing unit 12. Thus, foreign matter such as dirt, sticks, trash and lint may be trapped by the media 24 prior to reaching and clogging the inlets of the unit 12. Because of the removable nature of the cover 30, the fill 24 may be quite easily lifted out and cleaned or replaced should it become loaded with trapped extraneous materials.

I claim:

1. A substantially self-contained precooler attachment for air-cooled condensing units having ambient air inlets comprising:

a jacket adapted to at least partially envelope the exterior of a selected unit in upstream airflow relationship to said inlets, said jacket including an upright frame and porous media supported within said frame, said media being capable of permitting the gravitation therethrough of cooling water and the transverse flow of ambient air so that the latter may be precooled by said media before entering said inlets;

a manifold adjacent the normally upper portion of said media adapted to discharge water into the latter for said gravitation therethrough;

means for supplying water to said manifold;

a control operably associated with said supply means for activating and deactivating the same;

sensing means adapted for detecting the existence and non-existence of ambient air movement by the associated condensing unit resulting from operation and non-operation of the condensing unit respectively, said sensing means being operably associated with said control in a manner to cause activation of said supply means when the condensing unit is in operation and deactivation of the supply means when the condensing unit is in a state of non-operation; and a reservoir adjacent the normally lower portion of said media for receiving and collecting water gravitating through the media, said supplying means including a pump for recirculating water from said reservoir to said manifold, said supplying means further including means defining an inlet port for coupling the manifold with an external source of water under pressure, said control including a temperature-responsive valve operating to open said port when the temperature of collected water in said receptacle exceeds a certain predetermined level, said pump being provided with means for maintaining the same deactuated when said port is open as a result of the temperature of the water collected in said receptacle exceeding said predetermined level.

2. A precooler attachment as claimed in claim 1, wherein said pump is provided with a control preventing actuation thereof when the ambient air is below a certain predetermined temperature.

3. A precooler attachment as claimed in claim 1, wherein said jacket is provided with means for sealing air gaps between the jacket and the selected unit in order to restrict the inflow of ambient air to said media before reaching said inlets.

4. A precooler attachment as claimed in claim 3, wherein said sealing means includes an imperforate flap connected at one extreme to said frame and having means at an opposite extreme for releasably connecting the same to said unit.

5. A precooler attachment as claimed in claim 4, wherein said releasable connecting means includes ferro-magnetic structure attached to said flap and adapted for adherence to said unit.

6. A precooler attachment as claimed in claim 1, wherein said control further includes a valve adapted to close said port when the water collecting in said reservoir reaches a certain predetermined depth.

* * * * *